US008342959B2

(12) United States Patent
Mahaffey et al.

(10) Patent No.: US 8,342,959 B2
(45) Date of Patent: Jan. 1, 2013

(54) METHODS AND SYSTEMS FOR BETTING WITH PARI-MUTUEL PAYOUTS

(76) Inventors: Clayton R. Mahaffey, Stamford, CT (US); Guy Mahaffey, Humble, TX (US)

( * ) Notice: Subject to any disclaimer, the term of this patent is extended or adjusted under 35 U.S.C. 154(b) by 1241 days.

(21) Appl. No.: 11/998,185

(22) Filed: Nov. 29, 2007

(65) Prior Publication Data

US 2008/0113816 A1 May 15, 2008

Related U.S. Application Data

(63) Continuation-in-part of application No. PCT/US2006/020997, filed on May 31, 2006.

(60) Provisional application No. 60/926,150, filed on Apr. 25, 2007, provisional application No. 60/778,817, filed on Mar. 2, 2006.

(51) Int. Cl.
*A63F 9/24* (2006.01)

(52) U.S. Cl. ..... 463/28; 462/42

(58) Field of Classification Search ..... 463/28; 462/42

See application file for complete search history.

(56) References Cited

U.S. PATENT DOCUMENTS

| | | | | |
|---|---|---|---|---|
| 4,285,517 | A * | 8/1981 | Morrison | 463/9 |
| 5,573,244 | A * | 11/1996 | Mindes | 463/26 |
| 5,842,921 | A | 12/1998 | Mindes et al. | |
| 7,361,087 | B2 * | 4/2008 | Baerlocher et al. | 463/17 |
| 2003/0083118 | A1 * | 5/2003 | Nelson et al. | 463/9 |
| 2003/0157976 | A1 * | 8/2003 | Simon et al. | 463/1 |
| 2004/0005926 | A1 * | 1/2004 | LeFroy | 463/42 |
| 2004/0063484 | A1 * | 4/2004 | Dreaper et al. | 463/16 |
| 2004/0104845 | A1 * | 6/2004 | McCarthy | 342/463 |
| 2005/0124408 | A1 * | 6/2005 | Vlazny et al. | 463/28 |
| 2005/0171878 | A1 * | 8/2005 | Pennock | 705/35 |
| 2005/0181869 | A1 | 8/2005 | Downes | |
| 2005/0245306 | A1 | 11/2005 | Asher et al. | |
| 2006/0017224 | A1 * | 1/2006 | Seidman et al. | 273/138.1 |
| 2006/0148567 | A1 * | 7/2006 | Kellerman et al. | 463/42 |
| 2007/0026919 | A1 * | 2/2007 | Klitsner et al. | 463/7 |
| 2007/0102877 | A1 * | 5/2007 | Personius et al. | 273/138.2 |

FOREIGN PATENT DOCUMENTS

WO WO-2006/002494 1/2006

OTHER PUBLICATIONS

International Search Report published Dec. 7, 2006 as WO 2006/130624 A3.

Final Office Action in U.S. Appl. No. 11/141,957 dated Apr. 2, 2007.

Non-Final Office Action in U.S. Appl. No. 11/141,957 dated Sep. 21, 2006.

* cited by examiner

*Primary Examiner* — Dmitry Suhol
*Assistant Examiner* — Carl V Larsen
(74) *Attorney, Agent, or Firm* — Edwards Wildman Palmer LLP; Barry Kramer; George N. Chaclas

(57) ABSTRACT

A server for facilitating real-time betting, wherein the server communicates with clients via a distributed computing network. The server includes a memory storing an operating system, an instruction set, event data related to a sporting event, gambler data related to gamblers participating in a competition based upon the sporting event and site data related to electronic pages associated with the real-time para-mutuel betting. A processor runs the instruction set and communicates with the memory and the distributed computing network. The processor is operative to enroll the gamblers by presenting betting rules associated with the sporting event, collect wagering from the gamblers, accept predictions for discrete events within the sporting event from each gambler and determine a first winner of the competition based upon the predictions. Applications include lotteries with entries received from mobile devices.

18 Claims, 5 Drawing Sheets

Possible Pool Distribution Systems
Plan A- 50% to high score, 30% to 90% plus, 20% to 50%-90% Plan B- 100% to high score Operator Payout Rules

| | | | | | | | | |
|---|---|---|---|---|---|---|---|---|
| $/bet | | 1 | | | | | | |
| # gamblers | | 1000 | | | | | | |
| | A | | | | B | | | |
| Gamblers Rank | Plan A | Assumed Distribution ,Count | Pool, $ | Payout, $/gambler | Plan B | Assumed Distribution, Count | Pool, $ | Payout, $/gambler |
| Maximum | 50% | 5 | 500 | 100.00 | 100% | 5 | 1000 | 200.00 |
| 90% | 30% | 90 | 300 | 3.33 | 0% | 90 | 0 | 0.00 |
| 50% | 20% | 605 | 200 | 0.33 | 0% | 450 | 0 | 0.00 |
| 10% | 0% | 250 | 0 | 0.00 | 0% | 450 | 0 | 0.00 |
| Minimum | 0% | 50 | 0 | 0.00 | 0% | 5 | 0 | 0.00 |
| | 100% | 1000 | 1000 | | 100% | 1000 | 1000 | |

Figure 5

METHODS AND SYSTEMS FOR BETTING WITH PARI-MUTUEL PAYOUTS

CROSS-REFERENCE TO RELATED APPLICATION

This application claims priority to U.S. Provisional Patent Application No. 60/926,150 filed on Apr. 25, 2007 and is a continuation-in-part of international application No. PCT/US2006/020997 filed on May 31, 2006, designating the United States and published in English on Dec. 7, 2006 as international publication No. WO 2006/130624 A2, which claims priority to U.S. patent application Ser. No. 11/141,957 filed on Jun. 1, 2005 and U.S. Provisional Application No. 60/778,817, filed on Mar. 2, 2006, each of which is incorporated herein by reference.

BACKGROUND OF THE INVENTION

1. Field of the Invention

The subject disclosure relates to methods and systems for lottery and gaming technology in a distributed computing network, and more particularly to improved methods and systems for betting with pari-mutuel payouts while utilizing the real-time capabilities of a distributed computing network.

2. Background of the Related Art

Bookmaking is the practice of gambling on sporting events. A bookmaker or bookie is an entity that takes bets and pays winnings to the gamblers. Traditional bookmaking is generally illegal in the United States, with Nevada being a notable exception. In the United States, most bookmakers accept wagers on boxing, college sports, professional sports, horse racing and dog racing. In other countries, such as the United Kingdom, a wider range of bets is common such as outcomes of political elections, the Wimbledon tennis champion and the probability that it will snow on Christmas. Bookmaking usually pits the bookie against all bettors. In such instances, the bookie is referred to as the "house" and settles all wagers. For games of chance (e.g., card and dice games), the house is usually similarly pit against the gamblers with the house setting the odds heavily in their favor. For sporting team events, the bookmaker aims to guarantee a profit by achieving a "balanced book", i.e., by getting an equal number of bets for each outcome. To balance the book, the house creates odds such as requiring a $55 wager to win $50. As a result of even betting on both sides, the "vigorous" (e.g., the difference between the required wager and amount won) is made by the bookmaker on half of the wagers.

Another practice is to establish a betting line or "spread" in which one team receives points that are added to their total after the competition to determine the winner. When the spread is expertly set, a higher skill level is required to succeed. However, if a bettor believes that an unlikely event will occur, such as a large underdog winning outright rather than merely by winning with the spread added to their total, the bettor is not rewarded and receives the same payout as the underdog bettor who relied on the spread.

Cooperative wagering or pari-mutuel betting is a certain type of bookmaking. Pari-mutuel betting is commonly accredited as invented in the late $19^{th}$ century by Parisian perfume maker Pierre Oller. As the story goes, Oller was set on to the task by a bookmaker friend who wanted a fair system for bettors which guaranteed him a fixed profit. Unlike team sport betting, in pari-mutuel betting the gambler bets against other gamblers, not the house. In the United States, pari-mutuel gambling is very widespread and is frequently state-regulated. Horse racing, dog racing and jai lai are typical events that utilize pari-mutuel betting. Such events being of relatively short duration and having participants that finish in a ranked order are efficiently run under pari-mutuel systems.

In pari-mutuel systems, the holders of winning tickets divide the total amount of money bet on a race (the "pool"), after deductions for tax and house expenses (the "fixed profit"). The uniqueness of pari-mutuel betting lies in the fact that the payoff odds are calculated based upon how the gamblers placed their bets. For example in a horse race, if the majority of bets are on a single horse (a "favorite") and this horse wins the race, the payoff will be low because many winners will divide the pool. Conversely, if a horse with few bets placed on it (a "longshot") wins the race, the payoff will be high because few gamblers will split the pool. There are many different types of bets (e.g., win, place, show, perfecta, trifecta, daily double, etc.) in which case each type of bet has a pool associated therewith.

The large amount of calculation involved in pari-mutuel gambling led to invention of a specialized mechanical calculating machine known as a "totalisator" or "tote board". The first tote board was installed at Ellerslie Racecouse, Auckland, New Zealand in 1913, and tote boards are in widespread use at race courses throughout the world. The tote board records and displays the current odds in a near real-time basis so that gamblers may be aware of the odds while considering what bets to place. The science of determining the outcome of a race is called handicapping. It is possible for a skilled player to win money in the long run at this type of gambling, but overcoming the deficit produced by taxes, the house take, and losing is difficult to accomplish and few handicappers are successful. With the popularization of the Internet and Internet gambling, off-shore bookmaking operations can offer better payoffs because of their ability to establish themselves under more favorable tax regimes and reducing their house take. Such off-shore bookmakers take as little as 1% rather than the traditional 15-18% while still turning a profit. As would be expected, skilled handicappers and novices alike seek out the improved odds.

Progressive lotteries such as the POWERBALL® game have become celebrated in the United States despite several drawbacks. For example, initial payout is low, say $10 million and the sales build very slowly. Multi-jurisdictional products try to address this problem of jackpot fatigue by simply increasing the scale of the possible purchasing public. The ceiling on the prize is also limited according to the probability of winning. In other words, if the odds are 75 million to one and 75 million people play, there will likely be a winner. The POWERBALL® game odds are 146 million to one with a record largest jackpot of $365 million. As can be seen from this data, there is an effective jackpot ceiling because as the jackpot increases, the number of players increases. Further, marketing opportunities are restricted because the timing of a winning result is never known.

SUMMARY OF THE INVENTION

In view of the above, a need exists for methods and systems that utilize not only the tremendous computing power of modern electronic devices but advancements in the ability for such electronic devices to exchange data while leveraging the high demand for attractive pari-mutuel gambling.

It is an object of the disclosed technology to combine the very attractive features of pari-mutuel gambling with games and sporting events where one could only traditionally bet against the house. It is another object to incorporate advancements in communications that allow easily tracking events in real-time. It is another object to remove the risk for the house, which cannot easily balance the risk for real-time betting by varying the odds.

One embodiment of the subject technology is directed to a server for facilitating real-time betting, wherein the server communicates with clients via a distributed computing network. The server includes a memory storing an operating system, an instruction set, event data related to a sporting event, gambler data related to gamblers participating in a competition based upon the sporting event and site data related to electronic pages associated with the real-time para-mutuel betting. A processor runs the instruction set and communicates with the memory and the distributed computing network. The processor is operative to enroll the gamblers by presenting betting rules associated with the sporting event, collect wagering from the gamblers, accept predictions for discrete events within the sporting event from each gambler and determine a first winner of the competition based upon the predictions.

Preferably, the betting rules award predetermined amounts of points by comparing the predictions to possible outcomes of the discrete events and the first winner has the most points. The discrete events are infinitely variable such as plays in American football or player statistics in a plurality of categories such as points, rebounds, blocks and assists in basketball. In still another embodiment, the server is further operative to determine a plurality of winners based upon the predictions and distribute a pool created from the wagering to the plurality of winners on a pari-mutuel basis.

In still another embodiment, the subject technology is directed to a method for pari-mutuel betting. In the method, a server communicates with clients via a distributed computing network, the method includes the steps of enrolling gamblers by presenting betting rules associated with a sporting event, assigning point awards to categories, collecting wagers from the gamblers, forming a pool from the wagers, the pool being less than a total of the wagers, accepting predictions from each gambler for discrete events within the categories for the sporting event, allocating points to the gamblers based upon the predictions, determining rankings of the gamblers based upon the points allocated thereto and distributing the pool according to the rankings.

Still this embodiment may be further directed to a method that varies the point awards for a category in inverse proportion to a time remaining in the sporting event and/or wherein the sporting event is a card game or a game between two teams.

It is an object to provide a lottery game that has an improved initial payout with sales that build quickly. Preferably, the lottery is insurable so that the risk to the sponsor of a loss is minimized or non-existent.

In a further embodiment, the ceiling on the prize is unlimited or substantially greater than current lotteries with predictable payout dates that allow coincidental marketing opportunities. In one embodiment, such large prizes are generated because of very high odds against winning.

In still a further version, players can be placed in affinity groups and compete against other groups as well as the aggregated pool. Preferably, handicapped picks as determined by subject matter experts are automatically available and available for modification. In a still further version, the lottery climaxes coincident to a climax of an associated event so that synergy occurs between marketing the two events.

In still another embodiment, the predictions are made in realtime related to an upcoming event such as a swing, at bat, play and the like. In a further embodiment, the subject technology is applied to existing games or lotteries to provide a secondary or insurance pool for distribution to players who would otherwise receive nothing without an exact match.

It should be appreciated that the present invention can be implemented and utilized in numerous ways, including without limitation as a process, an apparatus, a system, a device, a method for applications now known and later developed or a computer readable medium. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

FIG. 5 is a table showing preferred pari-mutuel payouts distribution in accordance with the subject disclosure.

DETAILED DESCRIPTION OF PREFERRED EMBODIMENTS

Figure 1:
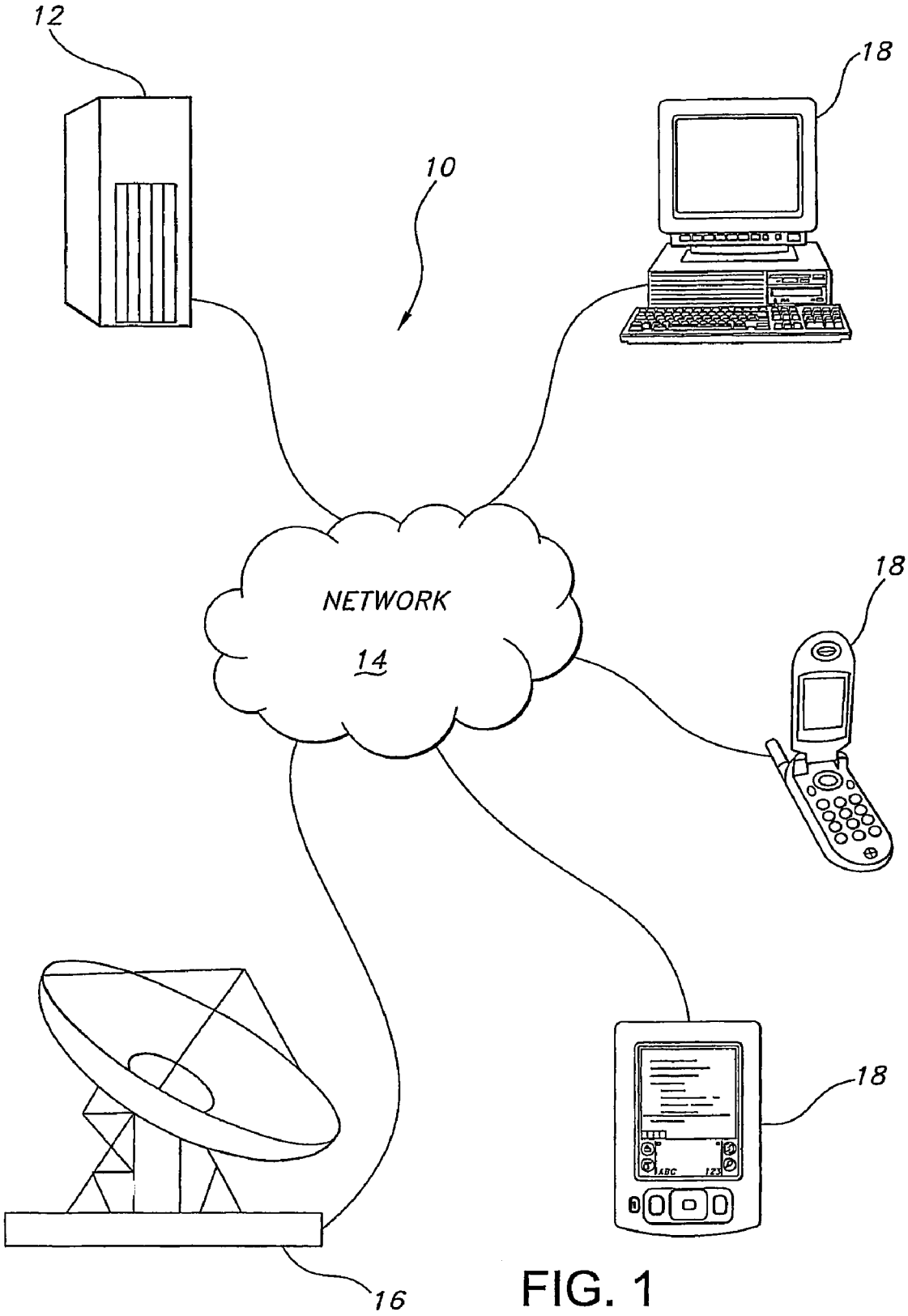
FIG. 1 is a diagram showing an environment for gambling with pari-mutuel payouts in accordance with the subject disclosure.

The present invention overcomes many of the prior art problems associated with traditional gambling. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Referring now to the FIG. 1, there is shown a block diagram of an environment 10 for implementing the methodology of the present disclosure. The environment 10 is hosted by an entity (hereinafter the house) so that a plurality of gamblers can bet against each other in real-time. The following discussion describes the structure of such an environment 10 but further discussion of the applications program and data modules that embody the methodology of the present invention is described elsewhere herein as would be appreciated by those of ordinary skill in the pertinent art.

The environment 10 includes one or more servers 12 which communicate with a distributed computing network 14 via communication channels, whether wired or wireless, as is well known to those of ordinary skill in the pertinent art. In a preferred embodiment, the distributed computing network 14 is a local area network set up at a casino. In another preferred embodiment, the distributed computing network 14 is the Internet. For simplicity, only one server 12 is shown. The environment 10 also receives input data related to sporting events from a broadcast device 16 in real time. The broadcast device 16 works as a component of a communications network such as that established by television and cable companies. In short, events of interest are sent up to a satellite in orbit and beamed back to the broadcast device 16 so that live broadcasts of events around the world can be viewed virtually anywhere. A plurality of clients 18 are also connected to the distributed computing network to allow a multitude of users to viewed the event and participate in the hosted gaming event.

Figure 2:
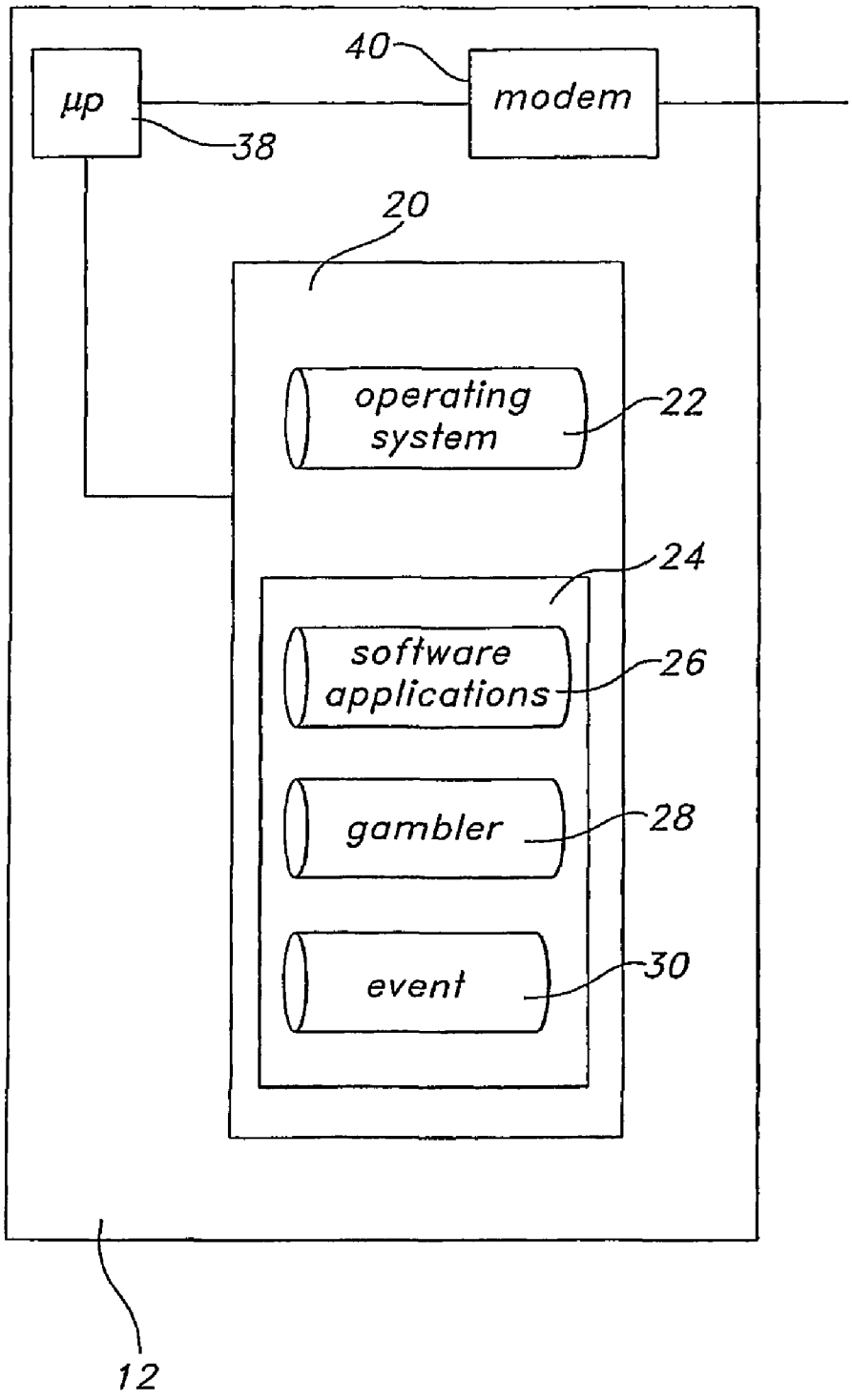
FIG. 2 is a schematic view of a server for use in the environment of FIG. 1.

Referring now to FIG. 2, server 12 hosts multiple sites and houses multiple databases necessary for the proper operation of the methods and systems in accordance with the subject invention. The server 12 is any of a number of servers known to those skilled in the art that are intended to be operably connected to a network so as to operably link to the plurality of clients 18 via the distributed computing network 14. As illustration, the server 12 typically includes a central processing unit or cpu 38 including one or more microprocessors such as those manufactured by Intel or AMD and memory 20 operatively connected to the cpu 38. The memory 20 can be any combination of random access memory (RAM), a storage medium such as a magnetic hard disk drive(s) and the like.

The memory 20 of the server 12 may be used for storing an operating system 22, databases 24, software applications 26 for execution on the cpu 38, and the like. In a preferred embodiment, a gambler database 28 stores data relating to each gambler in a relational database. The data relating to each gambler would include, without limitation, a unique gambler identifier, credit card data, bank account data, past betting history, current bets and the like as would be appreciated by those of ordinary skill in the pertinent art. An event database 30 stores data relating to past, present and future events upon which the house establishes a real-time pari-mutuel betting system or method in accordance with the subject disclosure. The data relating to the events would include, without limitation, time of the events, location of the events, detailed data relating to the event participants, the rules of the event, the types of bets allowed and the like as is described below with respect to specific examples.

The memory 20 of the server 12 also typically controls booting and storing the operating system 22, as well as other applications or systems that are to be executed on the server 12 such as paging and swapping between the hard disk and the RAM. Software, code or software applications 26 generally refers to computer instructions which, when executed on the cpu 38, cause interactions with operating parameters, sequence data/parameters, database entries, network connection parameters/data, variables, constants, software libraries, and/or any other elements needed for the proper execution of the instructions, within an execution environment in the memory 20 of the server 12. Those of ordinary skill will recognize that the software applications 26 and various processes discussed herein are merely exemplary of the functionality performed by the disclosed technology and thus such processes and/or their equivalents may be implemented in commercial embodiments in various combinations and quantities without materially affecting the operation of the disclosed technology.

The server 12 also includes other mechanisms and structures for performing I/O operations such as disk drives (not shown) and a modem 40 for communicating with the distributed computing network 14. It is envisioned that the server 12 can utilize multiple servers in cooperation to facilitate greater performance and stability of the subject invention by distributing memory and processing as is well known. U.S. Pat. No. 5,953,012 to Venghte et al. describes a method and system for connecting to, browsing and accessing computer network resources and is herein incorporated by reference in its entirety. Similarly, U.S. Pat. No. 5,708,780 to Levergood et al. describes an Internet server which controls and monitors access to network servers and is also herein incorporated by reference in its entirety.

Referring again to FIG. 1, distributed computing network 14 may include any number of network systems well known to those skilled in the art. The distributed computing network 14 can be a series of network nodes (each node being a digital data processing device, for example) that can be interconnected by network devices and communication lines (e.g., public carrier lines, private lines, satellite lines, etc.) that enable the network nodes to communicate. The transfer of data (e.g., messages) between network nodes can be facilitated by network devices such as routers, switches, multiplexers, bridges, gateways, etc. that can manipulate and/or route data from an originating node to a destination node regardless of any dissimilarities in the network topology (e.g., bus, star, token ring, etc.), spatial distance (local, metropolitan, wide area network, etc.), transmission technology (e.g., TCP/IP, Systems Network Architecture, etc.), data type (e.g., data, voice, video, multimedia, etc.), nature of connection (e.g., switched, non-switched, dial-up, dedicated, virtual, etc.), and/or physical link (e.g., optical fiber, coaxial cable, twisted pair, wireless, etc.) between the originating and destination network nodes. For example, distributed computing network 14 may be a combination of local area networks (LAN), wide area networks (WAN), or the Internet, as is well known. For the Internet, the preferred method of accessing information is the World Wide Web because navigation is intuitive and does not require technical knowledge.

The environment 10 also includes a plurality of input/output devices or clients 16 such as desktop computers with printers, laptop computers, personal digital assistants, cellular telephones and the like. The clients 16 communicate with the distributed computing network 14 to allow a user to access information on the server 12. For simplicity, only three clients 16 are shown. In the exemplary illustration shown, server 12 may be located almost anywhere but a plurality of clients 18 are permanent stations in a casino for accessing the environment 10. Clients 18 are also capable of being interconnected over great distances and/or directly to server 12 as would be known to those of ordinary skill in the art.

The clients 18 have displays as would be appreciated by those of ordinary skill in the pertinent art. The display may be any of a number of devices known to those skilled in the art for displaying images responsive to signals. Such devices include but are not limited to cathode ray tubes (CRT), liquid crystal displays (LCDS), plasma screens and the like. Although a simplified diagram is illustrated in FIG. 1 such illustration shall not be construed as limiting the present invention to the illustrated embodiment. It should be recognized that the signals being outputted from the clients 18 can originate from any of a number of devices including PCI or AGP video boards or cards mounted within housings of the clients 18 that are operably coupled to the microprocessors and the displays of the clients 18.

The clients 18 are also preferably equipped with an input device(s) as is known to those skilled in the art which can be used to provide input signals for control of applications programs and other programs such as the operating system being executed on the clients 18. In illustrative embodiments, the input device preferably comprises a switch, a slide, a mouse, a track ball, a glide point or a joystick, a microphone or other such device (e.g., a keyboard having an integrally mounted glide point or mouse) by which a user such as a consumer can input control signals and other commands. Although the use of a keyboard and mouse as an input device for the server 12 and clients 18 is not described further herein, it is within the scope of the present invention for the input device to comprise any of a number of input means known to those skilled in the art, wherein the control signals or commands for implementing and interacting with the environment 10 and the applications program embodying such methodology can be implemented in the form of commands from an input device.

The clients 18 typically include a central processing unit including one or more micro-processors such as those manufactured by Intel or AMD, random access memory (RAM), mechanisms and structures for performing I/O operations (not shown), a storage medium such as a magnetic hard disk drive(s), a device for reading from and/or writing to removable computer readable media and an operating system for execution on the central processing unit. According to one embodiment, the memory of the clients 18 is for purposes of booting and storing the operating system, other applications or systems that are to be executed on the computer, paging and swapping between the hard disk and the RAM and the like. In one embodiment, the application programs reside on the memory for performing the functions in accordance with the subject disclosure. In another embodiment, the memory simply has a browser for accessing an application hosted within the distributed computing network 14. The clients 18 can also utilize a removable computer readable medium such as a CD or DVD type of media that is inserted therein for reading and/or writing to the removable computer readable media. As can be seen from the above, a schematic diagram of a client 18 would indeed be functionally equivalent to the server 12 of FIG. 2 although one is not included herein and, for simplicity, several components are not shown.

It is also envisioned that a clients 18 provide administrative access to the environment 10 whereas clients 18 are associated with the house and gamblers although it will be recognized by those of ordinary skill in the art that the hardware of the clients 18 would often be interchangeable. A plurality of gamblers can share the same client 18, although probably not conveniently at the same time, and cookie technology can be utilized to facilitate access to the environment 10 and, thereby, gambling systems and methods conducted in accordance with the subject disclosure.

Figure 3:
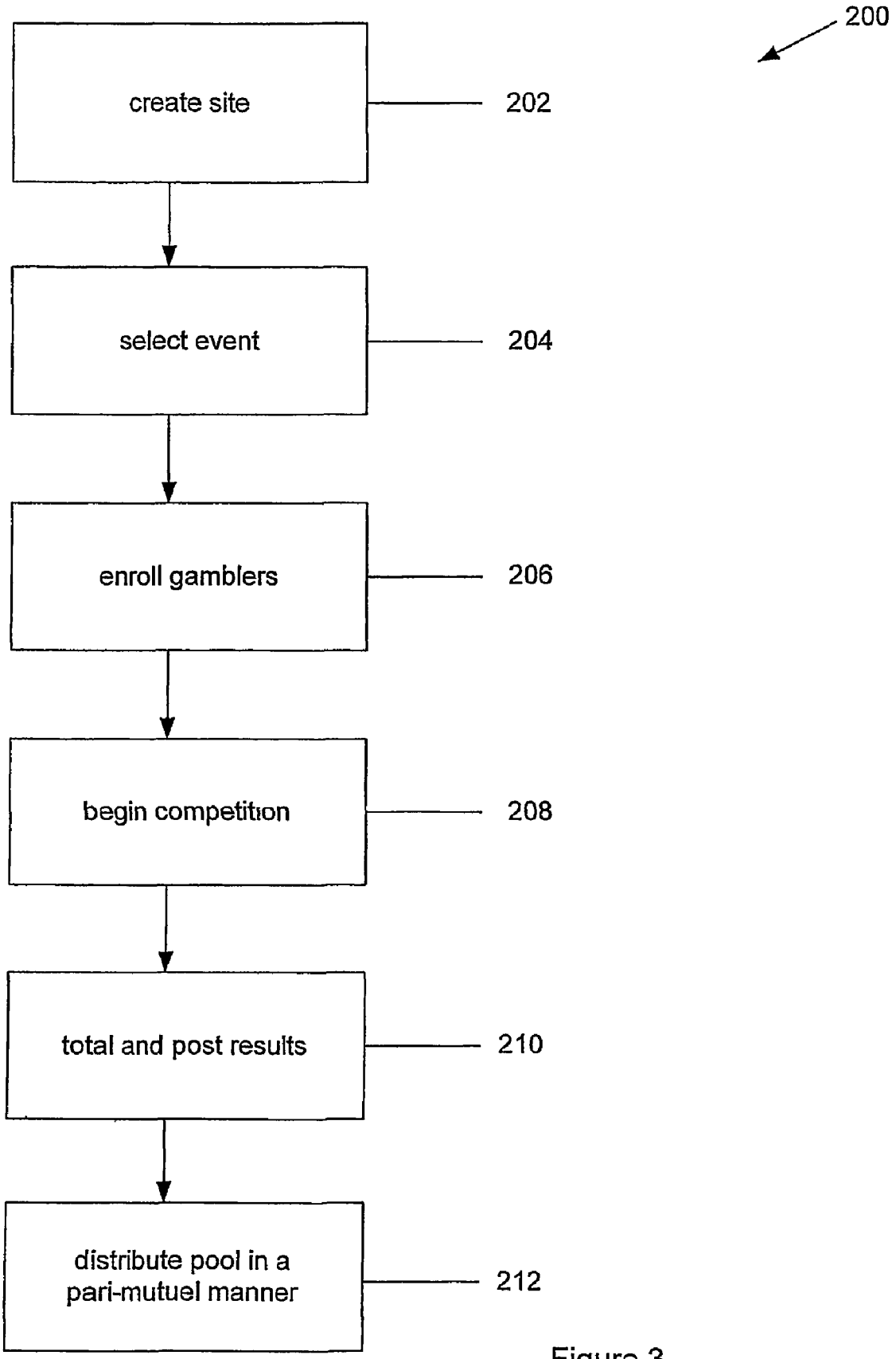
FIG. 3 is a flow diagram of a process performed to conduct gambling with pari-mutuel payouts in accordance with the subject disclosure.

Referring now to FIG. 3, there is illustrated a flowchart 200 depicting a process for real-time para-mutuel betting in accordance with an embodiment of the present invention. The flowchart 200 is directed to allowing gamblers to rely on their skill in predicting the outcome of plays within American football games. It is envisioned that this embodiment is located in an area of a casino set aside for the purpose of practicing the methodology of flowchart 200. Thus, the distributed computing network 14 may simply be a local area network connected to a local server 12 with a plurality of application specific designed workstations as clients 18. Such technology is well within those of ordinary skill in the art and, therefore, not further described herein.

It is envisioned that the house provides for administration and security maintenance. Such security is of particular interest if the distributed computing network 14 includes the Internet. Therefore, although many users may access the home site, even if such users do not become gamblers (e.g., Internet surfers, hackers and the curious), each user's access is controlled. The home site includes an input area for allowing a user to learn more about the gambling event and rules for same. The user interface specifies which aspects of the home site can be accessed, and at what level in order to maintain compliance with technical electronic data interchange standards, credit card processing, legal confidentiality restraints, system integrity and the like. Such limitations of functionality are well known to those skilled in the art and therefore not further described herein.

At step 202, the house creates a home site on the server 12 to present user interface screens to gamblers on the clients 18. The home site may have many different pages for presenting a plurality of events, where each event can be the basis of a gambling competition or events may be combined to provide more extensive competitions. The description below is with respect to one game but it would be appreciated that the subject technology is not so limited. Further, the house may maintain banner advertisements and links to related Web sites on the home site as a source of additional revenue. Preferably, the banner advertisements and links are associated with national and local vendors of complimentary goods and services and the company receives a further fee based upon referrals from same. The house also promotes the gambling system generally and specifically with respect to events chosen. It is also envisioned that a separate entity may provide the hardware and expertise necessary to practice the methodology for an entity that may want to run a gambling event for a particular event or charity on a one time or very limited basis.

At step 204, the house selects an event, in this case an American football game, to base a gambling competition upon. The live feed for the game may come over network television and be displayed on televisions in the area of the clients 18, be displayed on each client 18, be displayed in text form via an Internet game cast, combinations thereof and the like. As a result, each gambler who elects to participate can track the activity of the game in real-time. When the house runs such a gambling opportunity, the house preferably charges a fee of a fixed percentage of the pool. The fee may also be a set amount, a percentage of the pool plus a set amount, the greater of a percentage of the pool or a set amount and like arrangements as would be appreciated by those of ordinary skill in the art.

At step 206, the house enrolls gamblers in the gambling event via the user interface screens. By using a client 18 in a well-known manner, the gambler accepts the rules and provides the necessary input to the home site by selecting an icon, completing a questionnaire or the like. The house stores relevant data in records that are preferably stored in the gambler database 28 in server 12. In one embodiment, the gambler initializes their participation by contributing money into the pool such as $100 per game or $10 per quarter.

At step 208, as the football game begins, so does the gambling event. The gambling event or competition is according to rules set by the house. For example, the rules are based on the skill of the gamblers to predict the next play with varying points being awarded according to the accuracy of the prediction. The gamblers enter their predictions in real-time using the clients 18. The number of variables to be predicted include variables such as type of play (run, pass, punt, field goal), the name of the player running, passing or catching, the result of the play (gain, loss, number of yards gained or lost, turnover (fumble, interception), kicking yards, success of field goal). Variables may also include achieving milestones such as making a first down, scoring a touchdown and making a field goal or point after attempt. Bonus points can also be awarded for long yardage predictions such as touchdowns of over 30 yards and the like. Of course, picking the ultimate outcome of the game and including other variables such as the over/under line can be additional opportunities to add points to a gambler's total. For successfully and/or closely predicting each variable, a corresponding number of points is attributed to the gambler. Preferably, the gamblers are kept informed of details of the game like personnel changes, field position and the like. Bonus points may be offered for entering predictions prior to updates of such information. Similarly, pass attempts, play prediction and like statistics may have a point total associated therewith that decreases as time passes in recognition of the easier ability to predict such outcomes as the game progresses.

At step 210, the server 12 aggregates and updates the gambler's point totals after every play. Summary results are provided to all participating gambler's in real time. In one embodiment, the results are communicated by a scoreboard at the event. Gamblers may choose their own identifier or nickname to further enhance enjoyment of the competition. At the end of the football game, the gambler's final point total determines a relative placement of the gamblers.

Figure 4:
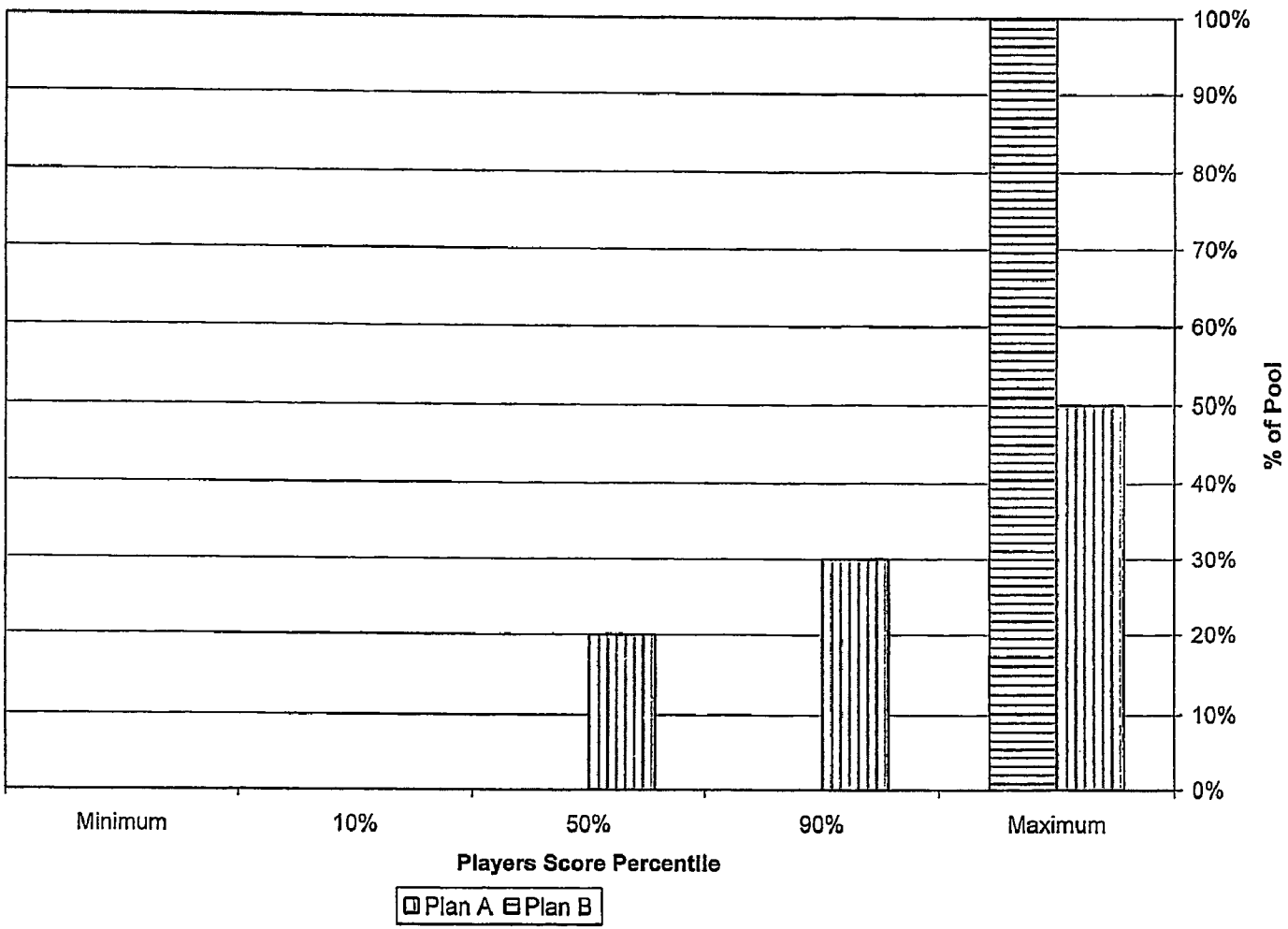
FIG. 4 is a distribution showing a preferred pari-mutuel payout in accordance with the subject disclosure.

At step 212, the house deducts a commission and pays out the balance on a pari-mutuel basis. For example, a certain percentage (50%) may go to the highest score, a second lower percentage may be divided equally among the second through fifth place finishers (%20) with the remaining percentage of the pool (%30) being divided equally among the remaining gamblers. As a result, each gambler is guaranteed some rebate and, for large pools, significant enticing payouts can be won. In another embodiment, a single winner with the highest score takes the pool. In another embodiment, multiple pools are created for the same game such as one that distributes a percentage of the pool on a quarter by quarter basis if for American football, and each gambling venue such as auditorium, bar, restaurant, casino, geographic area. Referring to FIGS. 4 and 5, various exemplary distributions for pari-mutuel payouts are shown.

It is envisioned that the sporting event may be not just a contest between two teams (e.g., soccer) but individual events (e.g., tennis, skating, gymnastics, diving), events scored by measuring time or distance (e.g., swimming, track and field), events determined by voting (e.g., academy awards, golden globe awards, political elections) or any circumstances which yield difficult to predict outcomes. In general, the house can select any number of categories for the gambler to predict and devise many schemes of point allocation.

For illustration without limitation, soccer can award points based upon predicting the outcome, the players to score, the time of the first and last goal and goal differential between teams. In American football, points can be based on the winner, margin of victory, exact score, next play (pass or run), next player to catch a pass, get 1st down, and score a touchdown, number of completions, touchdowns, and yards rushing. In basketball, points can be based on winner, margin of victory, exact score, who makes the next basket, points, assists, and rebounds for each player. In baseball, points can be based on winner, exact score, inning/outs when winning run scored, next pitch (ball, strike, foul, single, double, triple, home run or bunt), number of pitches thrown, number of balls and strikes, and hits allowed. In car and motorcycle racing, points can be based on winner, margin of victory, runnerup, time, top finishers for next lap, top finishers for the race which can be selected prior to the start of the race or at one or more additional times between the start and finish of the race, next car to take a pit stop, race time, total pit stop time, average speed and predicting the lap in a crash occurs. In soccer, points can be based on winner, margin of victory, time of winning goal, next player to score, next player to get yellow card, time of next goal, number of goals scored, penalties, and assists.

In Olympic gymnastics, points can be based on winner, margin of victory, exact score, score on next vault or event, scores on each event, and team score and rank. In casino slot-type games with pari-mutuel payout, points can be based on predicting the next 5 cards or the next 5 Mah Jong tiles. For blackjack, points can be based on predicting stay or bust for each of 6 players and dealer's total. For poker tournaments, points can be based on staying or folding for each player on the next hand, winner, and winning hand (pair of aces, straight, queen high, etc.). For horse and dog racing, points can be based on margin of victory, winner, time and other finishers. Gamblers can also create fantasy teams and receive points based upon the performance of the fantasy team and, in turn, place the gamblers based upon the point totals to determine payouts.

In another preferred embodiment, the house creates a large group of interactive gamblers for a card based game. Each gambler establishes an account for payment or allocation of required funds in the gambler database 28. The rules of the card game are stored in the event database 30. The game is based on electronic simulation of one or more decks of cards using random number generator technology as is known to those of ordinary skill in the art. Each gambler attempts to predict the outcome of the next card that is "electronically" turned over. Of course, the game could be based on actual cards being turned over with a live feed, written summary or other summary results fed into the environment 10 in real-time. The prediction could include the suit and number of the cards selected from a specifically designed user interface screen or hardware acting as a client 18.

The server 12 runs the game by interacting with the gamblers, scores each gambler's prediction, ranks the gamblers and transmits summary data to the respective client 18 of each gambler. The process is repeated for a deck of cards to complete a game. In a preferred embodiment, four points are awarded for selecting the correct suit. Awarding points for selecting the card value is determined according to the following formula for a deck of cards with thirteen cards per suit:

$$\text{value points} = \text{thirteen} - \text{absolute value of}(\text{predicted value} - \text{actual value}) \qquad \text{Formula 1}$$

For example, if a gambler predicted the suit properly but incorrectly guessed a five card value when the actual value was seven, the gambler would receive fifteen points (four based on the suit plus eleven for being close on the card value). Preferably, the house takes a percentage or vigorous of 10% for hosting the game and pays out the remaining pool to the highest scoring gamblers on a pari-mutuel basis.

The games may be repeated and played in rapid fashion to further add to the excitement and enjoyment of playing. The house may further increase the speed at which cards are turned so that an element of skill in card watching becomes a component of the game. Gamblers may also play several "hands" simultaneously as is common with other traditional games such as bingo. Technical constraints of the environment 10 may limit the number of hands that a gambler may have or require other additional constraints. It is also envisioned that the subject technology can be applied to almost any game such as, without limitation, Mah Jong, SCRABBLE® game available from Mattel, Inc., chess and the like.

As would be recognized by those of ordinary skill in the pertinent art, the subject technology can combine pari-mutuel payouts with the skill required for sports betting. Multiple predictions can be required to win a single bet. Some categories can be weighted more heavily or each successful prediction can have equal points awarded. Often, at least some return to each gambler can be arranged.

The subject disclosure is also highly relevant to lotteries. For example, an association is developed with sport seasons, building to a climax with the ultimate series or game for the respective sport. As a result, the lottery organizer and sports league have a symbiotic and mutually beneficial relationship, with a predetermined grand payout date. Further, the initial pay out is large, say $100 million to allow for the lottery association to conduct many more lotteries per year. Preferably, the lottery also has no ceiling but rather builds up to the predetermined ultimate game. By thus controlling the termination date, a marketing campaign is built around that event and combined with the inherent crescendo of the sport season finale.

One exemplary lottery in relation to American football works as follows. The bettor picks the score of each team for the entire weekend game slate or playoff round as the case may be. The range of individual team scores is set to 0 to 50 to produce 2500 possible outcomes. For 16 games, the number of possible outcomes is about 2500 to the $16^{th}$ power or $2.3\times10$ to the $54^{th}$ power, assuming the distribution is random. At such odds, the lottery has an initial payout of US $100M. Insurance is acquired in the event that insufficient funds are generated to cover the potential winner. Without a winner, there is a secondary weekly payout and with the balance being carried forward until the season ending event, e.g., the Super Bowl. On the final week, the balance of the accrued pool is distributed according to preset rules.

In more detail, the bettor picks the score of each team for the entire weekend game slate or Tournament round by using pencil and paper which is scanned in by a client 18, entering the selection directly at a client 18 such as a telephone, an Internet connection or like portable device or networked device. The initial jackpot is set to $100 million. Individual games are scored according to the algorithm described below at paragraph 61. The scores for each game are totaled for that time period or cycle, e.g., week. If the jackpot is not won, then a portion of the pool is carried forward to the next week and the balance of the weekly pool distributed to the subordinate winners on a pari-mutuel basis. Due to the low probability of predicting the exact score, a large range of subordinate prizes are awarded weekly on a pari-mutuel basis so that the total odds of winning are within the range of one in 35. As a result, consumers have confidence in the lottery and an acceptable possibility of winning. The jackpot pool is carried forward until the season ending event, e.g., the Super Bowl, when the jackpot pool is distributed to the highest scoring person. Additionally, a portion of the jackpot could be reserved to be distributed among second place and lower finishers. It is also envisioned that this lottery may be organized in a multi-jurisdictional basis with an automated pick option. The automated pick option is selected from the group including a consensus betting spread, an over/under number, or that of particular touts (well-known personalities), or system bets enabling random combinations of scores for one or more teams about a range of possible outcomes.

In one embodiment, the distribution of subordinate bets is adjusted weekly according to the actual scores received by participants. For example, the players' scores are ranked from high to low, and for each numerical score there are a number of players. The number of players with each score is added to that of the higher score until the desired number of subordinate winners is obtained. The lowest score for which a cash prize is adjusted so that the sum of players receiving payment is equal to some desired or accustomed standard, e.g., one of 36. Additionally, the payoff cash prize level for each score score, or range of scores is varied to balance the interests of the players and sponsors. Preferably, the rules are posted on a Web site with an example of how to score. Of course, the scoring is also automated. Weekly results can be communicated to players by posting a winner, the top 10 and/or the top 100 on the lottery Web site. The winners can also be notified by electronic mail with or without a media press release. Players can also scan their ticket (such as by using bar code technology) at point of service terminal where tickets are sold. Players can also log in at the lottery Web site hosted on server 12 and enter a user identification (e.g., electronic mail address) and password to view or receive a message relating to the standings. Preferably, the Web site will display associated predictions, score, rank and amount won, if any. Alternatively, players use an electronic template to score selections or print the template and perform manual calculations. The template could also be used to print out a prediction sheet/card.

In addition an interesting dynamic may develop between sports "handicappers" who have expert knowledge or opinions of the teams, and straight lottery players who make 'quick pick' selections and are just looking for the big payout. Normally sports handicappers do not buy lottery tickets because they are aware of the low payout (typically 50% of sales are given out as prizes). However, depending on the subordinate prize distribution rules the handicappers may participate in order to collect the subordinate prizes which could be quite substantial due to sales generated by the lottery players attracted to the jackpot payout only.

Further, the lottery includes automated number picking including additional options such as games over a betting spread, an over/under line as well as a a random distribution about the possible scores. Preferably, handicapped picks as determined by subject matter experts are automatically available. Alternatively, the handicapped picks can be used as a starting template with minor modifications to customize the selections. Further, it is appreciated that such a lottery could be advantageously applied to any sport or contest such as, without limitation, baseball, basketball, soccer, rugby, tennis, figure skating, snowboarding and the like.

To further illustrate the innovative concepts of the subject disclosure, several particular examples follow. These examples are in no way meant to be taken in a limiting sense. It is noted that the lottery or like game may not be monetarily based but rather performed as a game of skill played in an effort to win non-monetary prizes. The prizes can be awarded at various intervals in the sports season.

American Football

It is required to predict exact score of one or more games with points attributed as follows: 50 points for predicting the winner; 20 points for predicting the exact margin of victor; 15 points for predicting the exact score of the winning team; and 15 points for predicting the exact score of the losing team.

A sliding scale would award fewer points for each point away from an exact prediction with a 100 point maximum for each game. To make the competition applicable to college athletics, a slate of 15 NCAA games could be identified so a total maximum score would be 1500. The players with the highest score are the winners. Secondary winners could also be awarded with reduced payments.

Soccer

For soccer, the competitor's input could be the score of each team at the half and/or end of game, or time of last goal scored.

Golf

One exemplary scoring system is as follows: 60 points for predicting the winner; 10 points maximum for predicting the exact score of each of his rounds; and same for each of the next four finishers of the tournament. In a realtime game, points may be awarded for predicting the result of the next shot of a specific golfer. In one embodiment, the predictions are multiple choice such as in the fairway/not in the fairway, on the green/not on the green and in the hole/not in the hole.

Tennis

One exemplary scoring system is as follows: 60 points for predicting the winner of each match; 20 points for predicting the exact point total for the winner; and 20 points for predicting the exact point total for the loser. 100 maximum points is available for each match and the highest score for each round and/or tournament is a winner.

Tour de France

One exemplary scoring system is as follows: 1, 2, 3, 4, 5 points for predicting the top 5 finishers in each leg of the event; and 10 points maximum for predicting the exact time of each leg.

NASCAR, Indy 500, Lemans and other car racing events

The gambler predicts the order of finish of a racing event by inputting the car number in response to a prompt from the server, cell phone or wireless device. An example scoring algorithm could be: if actual finish order equals predicted, 200 points; if actual finish order equals predicted +/−1 place, 100 points; and if actual finish order is in top tier (tier=2, 3, 4, 5 or more), 50 points.
For example:

| Car # | Predicted Order | Actual Order | Points |
|---|---|---|---|
| 43 | 1 | — | 0 |
| 21 | 2 | 3 | 100 |
| 13 | 3 | 1 | 50 |
| 9 | 4 | 4 | 200 |
| 17 | 5 | — | 0 |
| Etc | | | 350 |

A separate pool could be conducted after the start of the race with the same or modified algorithm. One exemplary scoring system is as follows: 50 points for predicting the winner; 50 maximum points for predicting the exact time of the winner; and Same for the next 4 finishers.

Olympics

One exemplary scoring system is as follows: Team scoring where points are awarded for predicting the number of gold, silver and bronze medals won by each country with 50 points for the country with the highest medal count; 50 points maximum for predicting the exact number of medals; and same for the next 9 finishers. Individual scoring is also possible where points are awarded for predicting the top four finishers of each event and their score as follows: 50 points for predicting the gold medallist; 50 points maximum for predicting his/her score/time/distance; and same for the next 3 finishers. The highest total score for each sport—gymnastics, track, swimming, is a winner. Competitors may predict the score awarded to an individual athlete's performance either for a sub event within a plurality of scored events (an individual dive in a multi dive contest, pummel horse or rings within gymnastics, etc), the total of the sub events for an individual or team.

Horse and Dog Racing

One exemplary scoring system is as follows: 1 point for predicting the $1^{st}$ place finisher; 2 points for predicting the $2^{nd}$ place finisher; 3 points for predicting the $3^{rd}$ place finisher; and 4 points for predicting the $4^{th}$ place finisher. The totals are added for some or all races with a top cumulative score being the winner.

In another horse racing scenario, the bettor picks the exact order of finish for the 1st n places for each race, which is repeated for multiple races. With 10 races and 10 horses in each race, the odds to pick the top 4 in order in a single race are 1 in 5040. To pick 10 races, the odds are one in 10 to the 37th power 5 races is $3\times10\ 18^{th}$ power. Where Xp is predicted finish order and Xa a is actual finish order the absolute value could be taken of the difference between Xp and Xa. For example, see the chart below:

| Horse # | Xp | Xa | Abs Value |
|---|---|---|---|
| 2 | 1 | 2 | 1 |
| 3 | 2 | 7 | 5 |
| 7 | 3 | 1 | 2 |
| 8 | 4 | 4 | 0 |
| 10 | 5 | 8 | 3 |
| 5 | 6 | 6 | 0 |
| 1 | 7 | 9 | 2 |
| 9 | 8 | 10 | 2 |
| 6 | 9 | 5 | 4 |
| 4 | 10 | 3 | 7 |
| | | Total | 26 |

In this example, the lowest score wins. Another example could assign a weight value to each finish order. The weighting could be direct, 1 for $1^{st}$ place, 2 for $2^{nd}$ place, 3 for $3^{rd}$ place, etc or reverse, 10 for $1^{st}$ place, 9 for $2^{nd}$ place, 8 for $3^{rd}$ place, etc. For example:

| Horse # | Xp | Xa | Abs Value | Weight | Wt − Abs Val |
|---|---|---|---|---|---|
| 2 | 1 | 2 | 1 | 1 | 0 |
| 3 | 2 | 7 | 5 | 2 | −3 |
| 7 | 3 | 1 | 2 | 3 | 1 |
| 8 | 4 | 4 | 0 | 4 | 4 |
| 11 | 5 | 8 | 3 | 5 | 2 |
| 5 | 6 | 6 | 0 | 6 | 6 |
| 1 | 7 | 9 | 2 | 7 | 5 |
| 9 | 8 | 10 | 2 | 8 | 6 |
| 6 | 9 | 5 | 4 | 9 | 5 |
| 4 | 10 | 3 | 7 | 10 | 3 |
| | | | | Total | 29 |

In this example, the highest score wins.

Preferably, the favorite is the easiest to pick, so it is awarded the fewest points. A portion of the total pool is allocated to the jackpot, and is carried forward weekly until it is won or otherwise distributed to the highest score at the final race of the season. Subordinate wagers paid out weekly pari-mutuel basis. As can be seen, a guaranteed prize can be offered for a perfect prediction because the odds of a perfect prediction my be billions to 1, and thus, easily insured. This system uses a scoring algorithm to create a score for multiple selections in each race which are then cumulated for the entire day. The final total score then enables multiple payouts based on pari mutuel basis which is well understood by racing fans.

This is not possible with current exacta, daily double and current wagers which have the common "all or none" feature. The input could include a feature to accept the track handicapper's prediction without additional input by the bettor, or that of an individual (e.g., a tout), or system bets covering various combinations of one or more horses (similar to a box bet).

Lottery

A lottery system is devised with the probability of winning so low that a relatively high payout can be offered from the first week and still be able to be insured on a cost effective basis. By using a combination of 10-16 sports teams, the lottery has high odds such as $10^{54}$ or $20^{54}$. The lottery system uses an algorithm scoring system of conventional sports teams predictions enabling a wide range of subordinate payoffs to be made based upon point accrual. The lottery system uses rules of pari-mutuel payouts and progressive carry forwards to ensure a jackpot will be won at any desired round of the lottery. In addition, a greater number of subordinate distributions can be made than is possible with a conventional lottery matrix. Referring now to the table below for example, if you have a lottery matrix of pick n of y numbers, plus 1 of z additional numbers, then the number of levels is the product of n×z+z. However, current lotteries can not pay out on all possible levels. Below is a typical payout grid for a 5/55 plus 1 progressive lottery. The prizes for picking 2 or 3 numbers without the powerball (2/0, 3/0) are not paid due to the large numbers of winners that would result. This inherent flaw is avoided in the proposed lottery system.

regardless if someone picks all the numbers correctly. This also allows for insurance guarantees of large jackpots for perfect predictions. If the lottery game has odds of 30 billion to 1, an insurance policy could be purchased that would pay $1 billion in the unlikely event that someone correctly picked all the numbers. One example is to choose seven numbers from 1 to 99. A scoring system is applied to determine the closest prediction such as total number of digits away from drawn numbers, possibly weighted, and/or most numbers matched. A certain percent of the pool is paid out on a pari-mutuel basis to the closest prediction(s). Secondary winners can also be paid. A certain percentage of the pool can also be carried over to the next drawing if no one correctly predicts all seven numbers. In another example, the lottery is to predict numbers to be drawn in the correct order based on choosing six numbers from 1 to 60. A perfect prediction must pick all the correct numbers and in the same order as they are drawn. A scoring system is applied to determine the closest prediction with one possibility as follows:

| | | |
|---|---|---|
| Example: | Predicted numbers- | 16, 4, 27, 39, 12, 51 |
| | Actual numbers drawn- | 13, 28, 32, 8, 44, 54 |
| | Absolute value of difference | 3 + 24 + 5 + 31 + 32 + 3 = 98 |

The lowest score is guaranteed to win the predetermined percentage of the pool, e.g. 50%. The other 50% of the pool could have subordinate prizes and the excess would be carried over and continue building until someone correctly predicted 5/55 and 1/42 Matrix and Power ball Payout Schedule

| # Matches | Power ball | Total # Combinations | Odds | # Winners | Prize Value | Prize Cost | Prize Cost, % Sales | Jackpot, % Prizes |
|---|---|---|---|---|---|---|---|---|
| 5 | +1 | 1 | 146,107,962.00 | 1 | 44,253,951 | 44,253,951 | 30.29% | 60.6% |
| 5 | +0 | 41 | 3,563,608.83 | 41 | 200,000 | 8,200,000 | 5.61% | |
| 4 | +1 | 250 | 584,431.85 | 250 | 10,000 | 2,500,000 | 1.71% | |
| 4 | +0 | 10,250 | 14,254.44 | 10,250 | 100 | 1,025,000 | 0.70% | |
| 3 | +1 | 12,250 | 11,927.18 | 12,250 | 100 | 1,225,000 | 0.84% | |
| 3 | +0 | 502,250 | 290.91 | 502,250 | 7 | 3,515,750 | 2.41% | |
| 2 | +1 | 196,000 | 745.45 | 196,000 | 7 | 1,372,000 | 0.94% | |
| 2 | +0 | 8,036,000 | 18.18 | | 0 | | | |
| 1 | +1 | 1,151,500 | 126.88 | 1,151,500 | 4 | 4,606,000 | 3.15% | |
| 1 | +0 | 47,211,500 | 3.09 | | 0 | | | |
| 0 | +1 | 2,118,760 | 68.96 | 2,118,760 | 3 | 6,356,280 | 4.35% | |
| 0 | +0 | 86,869,160 | 1.68 | | 0 | | | |
| | | 146,107,962 | 36.61 | 3,991,302 | | 73,053,981 | 50.00% | |

Current lotteries have to make the odds high enough to build a large jackpot, but low enough that someone will win in a reasonable amount of time. This is a limitation of current games. In one embodiment, a lottery is created that is possible to predict, but not probable. A scoring system is applied to determine the winner in the likely event that no one picks all the numbers correctly. For example, if the odds are 30 billion to 1, it's possible someone can predict the exact numbers, but not probable if only 30 million tickets are sold. This game, however, can guarantee a winner for every drawing (e.g., whoever is closest). A certain percent of the pool can be paid to the closest pick(s) and the rest carried over to the next game or until someone correctly picks all the numbers. This concept can allow pots to build larger than current lottery pools while paying out large guaranteed amounts for every drawing all numbers in the correct order or an arbitrary end to the game is scheduled e.g. New Year's Eve. The envisioned game and scoring system could have multi-million dollar payouts to the closest score even if the player did not correctly pick any of the drawn numbers. Lottery games are also envisioned where Keno or Bingo can be played and the scoring system applied to determine the closest to the drawn numbers. Current Keno games use fixed odds, which makes it difficult for anyone to win a large amount. Bingo players must match five numbers all in a row in order to win. The envisioned game would apply a scoring system to Keno and Bingo drawings to allow a guaranteed winner to the player with numbers closest to the numbers drawn.

In brief overview, an envisioned embodiment creates games where it is possible to make predictions of the outcome, but not probable. A scoring system is applied to determine which player has the closest prediction or outcome. Player funds are pooled together and a certain percentage is paid to the player with the best score. The operator retains a set percentage for profit and winners are paid on a pari-mutuel basis. Additionally, a certain percentage of the pool can be carried over to the next game. It is also important to note that all of the envisioned games can be played in various mediums including, but not limited to computers, video terminals, TVs, mobile telephones, hand held devices or paper systems.

For example, the following games can be played for lotteries, sports betting, or "fantasy" type games. Fantasy type games may be free to play, or charge an entry and/or subscription fee. Prizes or recognition could be given to the winner(s). Lotteries and sports books can charge a set fee for each game or event. A realtime example of the envisioned system as applied to American football would be to predict which team will score next and how much (1, 2, 3, 6 points); and/or predict what the next play or next play result will be (pass, run, left, right, center, punt, fumble, interception, gain, loss, amount of gain or loss, etc.). An algorithm will assign a score to all predictions based on accuracy, closest to the score, closest to yardage, type of play, direction of play, yardage gained, lost, and the like. Players' scores are compiled and the player with the highest score wins. It could further assign points for predicting the final game score after the game starts at various intervals such as at the end of each quarter.

For realtime betting on baseball, players predict how many runs each team will score in each half inning, e.g, typically eighteen predictions per game. The scoring system is applied to determine closest cumulative prediction. It could further assign points for predicting the final game score after the game starts at various intervals such as at the end of each inning or half inning. Similar games can be played for all team and individual sports including but not limited to soccer (English football), basketball, tennis, car racing (NASCAR, Formula One, etc), cycling, hockey, rugby, cricket, boxing, and all Olympic events.

The realtime concept can be applied to predicting multiple races with the scoring system applied to determine closest prediction. For example in horse racing with a multiple race prediction, only one race is predicted at a time. The exact order of finish for each horse is predicted for the first race. Each player returns the ticket to the betting window to predict the finish of all horses in the next race. A bar code confirms same player is adding his second prediction. This continues for a total of eight races. The scoring system is applied to determine player with the closest prediction for all eight races with payouts made on a pari-mutuel basis. A certain percentage can be carried over to the next race or the next day of races if no one makes a perfect prediction.

In casino games, like slot machines, video terminals and other such devices, lottery games can be played similarly to the lottery games of predicting numbers. Keno and Bingo can also be played on the video terminals. Machines or terminals could be linked together similar to current "progressive jackpot" slot machines. The difference is that the envisioned games would be played in real time. The games, for example, could be played every few minutes. The number of players playing at one time could be a handful or a few hundred or even thousands. A scoring system would be applied to determine the closest prediction and a guaranteed payment paid to the winner. A percentage would carry over to the next game until someone correctly predicts all numbers exactly. For example, multiple video terminals in a casino or casinos are linked together to the same computer or processor. Two or more players push a button or touch the screen or otherwise indicate that they have placed money or credits in a machine and are ready to play. The players will then be notified that they have 30 seconds to select six numbers or select the auto-pick option so the computer will randomly generate six numbers. A timer counts down until the 30 seconds are up. The computer then randomly generates 6 numbers that are simultaneously displayed on every screen of the linked players. A scoring system is applied to determine which player's numbers are closest to the randomly drawn numbers. Payouts are made on a pari-mutuel basis, e.g. 50% to the player with the closest score. Secondary winnings could also be credited to other players. The remaining percentage (less the casino rake) could be carried over to the next game so the pot would build until someone correctly matches all the numbers. This game can also be played similarly in real time for Bingo, Keno, Blackjack, roulette and other casino table games.

A deck of cards can also be used. Players select six cards or opt for the computer to randomly select six cards for them. After 30 seconds, the computer displays six cards on all players' screens and the scoring system determines which player was closest. Video poker can also be played in the same manner. Current casino or poker games pay out on fixed odds. The difference between the actual odds and the paid odds are the casino's profit. The envisioned system allows the casino to make a fixed commission or rake on each game played. It also allows players to play against each other on a pari-mutuel basis instead of playing against the casino. Progressive jackpots build for each game if no player has a perfect score. Current casino games are configured so that the odds slightly favor the casino. The envisioned system uses a scoring system and real time play to create pari-mutuel casino games where the casino gets a guaranteed rake on every game. It also guarantees that at least one player will win each game. Players compete against each other instead of against the computer.

Mobile Applications

The use of mobile devices for lotteries and sports betting presents the opportunity to enable the games described above as well as other versions as would be apparent to those of ordinary skill in the art upon review of the subject disclosure. For example in a NASCAR® race application, the player dials a pre-selected telephone number to play the game, the mobile phone sends prompts to the player to input the car number for each finish position and results are scored according to a system. The entrance fee is cost of the call billed to user's account, results are emailed. A percent of the pool is distributed to the high scorers according to the rules and payment made by credit to their account, a check from the mobile operator and the like. Additionally, the game could be marketed by encouraging viral networking. As a result, the Internet sports betting web sites, credit card input, and the like are bypassed to reach a much larger market than the Internet alone. Of course, such a scheme can be implemented to football, soccer and other competitions.

Secondary Pools

Another application of the subject technology is to offer lottery players and the like an insurance ticket for an additional monetary amount. All players that buy the insurance ticket are entered into a pool with a chance to win a secondary prize. An algorithm or scoring system is applied to determine which player in the insured ticket pool had the closest prediction to the actual numbers drawn. The winner(s) is paid on an pari-mutuel basis. For example:

| | |
|---|---|
| Predicted numbers- | 16, 4, 27, 39, 12, 51 |
| Actual numbers drawn- | 13, 28, 32, 8, 44, 54 |
| Absolute value of difference | 3 + 24 + 5 + 31 + 32 + 3 = 98 |

The insurance pool is largely the same as the traditional lottery game (e.g., as POWERBALL® or MEGAMILLIONS® lotteries), but is applied as a secondary play for an existing lottery game that has completely different rules. The insurance pool applies equally as well to other games such as horseracing where the exact prediction is normally needed to win. For example, horseracing has a traditional pick six bet where the better has to pick the winner of 6 consecutive races. An example of an insurance pool calculation follows:

| Race # | Horse | Xp | Xa | Abs Value |
|---|---|---|---|---|
| 3 | 4 | 1 | 1 | 0 |
| 4 | 2 | 1 | 2 | 1 |
| 5 | 7 | 1 | 6 | 5 |
| 6 | 4 | 1 | 3 | 2 |
| 7 | 8 | 1 | 1 | 0 |
| 8 | 5 | 1 | 4 | 3 |
| | | | Total | 9 |

In this example, the lowest score from the insurance bet pool wins a secondary amount.

Another Poker Game

Limitations of traditional poker are the requirements that no more then 7-10 players can play at one time due to the number of cards per hand (5 or 7 usually) and the 52 cards in a single deck. Also poker is intimidating to many people who have not made the investment of time to learn the rules, understand what hands are likely to win, and the mechanics and strategy of wagering (call, raise, and fold). Additionally players all understand one or more of them may be bluffing which further complicates matters. If a player is not expert in the game, the potential player may feel a fear of embarrassment in front of the assembled group, which prevents the player from participating. Poker can also be a slow game as players contemplate their cards and wagers. Another inherent weakness is the poor hands that drop out and have nothing to do until the next hand. Consequently, many potential poker players prefer slot machines because they are fast and simple, easy to understand, are less stressful and there is no chance of embarrassment by making a wrong play in a public group.

Video poker games became enormously popular over the last 20 years because they resolve these problems of standard table game poker. A problem with video poker is that it is a solitary game where the player is playing against the fixed odds offered by the operator which are less than the true odds. Another inherent problem with video poker is the only way to improve the initial hand is to draw more cards to try and achieve a better poker hand.

Internet poker is now popular since it enables players from anywhere in the world to play against each other according to conventional rules. There are often thousands of players online at any of dozens of poker web sites. Therefore there should be market demand for a new game combining a modified poker game with a game of chance.

The poker modifications envisioned are simplified wagering rules (e.g., fixed wagers, no raises); players playing from their own individual card deck and the Community Cards are played by all from an additional deck. This allows an unlimited number of players in the game and simple, simultaneous wagering (e.g., fixed wager amount and either call or fold) as opposed to the conventional sequential wagering. The simultaneous chance game is based on the cards that have not yet been played. The player has the option to predict the next card and receive points based on 'how close' the prediction is to the actual result. The point allocation algorithm can be established by the operator. The new combination game would be played simultaneously by an unlimited number of players providing a significant pool to be shared by the winners. At the end of the poker hand, the players would self select (declare) into one or both of two pools, the pools being the best poker hand or the best chance hand. The players would be aggregated whether playing over the Internet or within a single or multiple of casinos (e.g., a private network).

A scoring system may be where players predict an event, are given points for how close they are to that actual event, then aggregating those players into a pool, and distributing the pool on a pari-mutuel basis according to their score. This is described herein in a general context whether for sports events, lotteries or card games.

For a seven card poker game such as Texas Hold'm, the players would initially receive two cards down followed by 3 cards up (community cards played by all players), then a $6^{th}$ card up, then a $7^{th}$ card up. The hole cards of each player would be from individual decks and the community cards from another single deck. By using multiple decks, the odds of having any given poker hand are significantly improved since the player essentially has two extra chances to achieve any hand. In addition, the highest possible hand would be 6 aces (four in the community deck and two in the hole deck) if a six card hand was allowed and so on.

The corresponding chance game requires predicting the next card(s) (either three on the flop or one for the $6^{th}$ and $7^{th}$ cards) from a single community deck. The player would receive points for how close this prediction was to the actual event whether a single card play or cumulative for the entire hand. The probability of predicting the next five cards, taken in sequence as envisioned in this game, is based on the number of permutations of 52 cards taken 5 times or ${}_{52}P_5$ which is 311,875,200. So the odds against achieving this feat are 311,875,200 to one. This is substantially higher than the odds against getting a royal flush which are 649,615 to one for a standard 5 card hand and single 52 card deck. This enables very attractive fixed odds during the play of the game. The fixed odds may approach that of large lotteries and be offered to selected players with Chance point hands exceeding some target value, or the highest possible value. This enables multiple wagers within the play of the hand if the game is played over the Internet through a server so that each players hand is known. The Operator can offer fixed odds to each of the numerous players if they can predict the next card or two cards (e.g., a Chance play) or to complete a standard poker hand (e.g., a Poker play).

Since the operator is aware at all times of the number of players in the game and the size of the pool, and the Chance 'points' for each player, and the poker hand of each player and how it ranks relative to all others, the operator can make make cash offers to players prior to the natural termination of the game. The cash offers can be either selected by random or their rank amongst all players. The operator can determine the highest poker hand and make an offer to that player, using the Internet, text message or other means, that is either private to that person or broadcast to all players, of a certain amount and that person must decide within the time allowed whether to accept or not. The same can be done for the person with the highest 'points' in the Chance game, or to other players. This may be repeated one or more times for each wagering round. If the 1st person refuses the offer, the same or a different offer can be made to the next highest and so on.

The players starting the game have no reason to drop out if their poker hand is weak since the Chance play can offer appealing odds, is simple and high potential payouts. The result is a fast, compelling game with excitement, high payouts, simplicity that will keep players 'in the game' as the cards are played.

As an example if the total pool collected from all players from the ante and each fixed wager round was $1,000 and the operator set game rules to hold 10% then $900 could be split between the Poker and Chance winners; $450 to each. The offer made to the high poker hand, say after the flop or when 3 cards are visible to all, would be less than the $450 he would win if he stayed in the game until the last card and ended up with the best hand. The operator could set the size of the offer based on a variety of factors including past results, the true odds of that person winning, perceived appetite for risk based on all other players in that position or that person specifically (based on prior wagering patterns on the site) and other factors standard to poker well known to those skilled in the art. If the person accepted the interim prize, he would be removed from the game, the prize pool reduced by that amount, and then the game continues to the next card.

The operator can establish fixed odds payouts for certain poker hands or point values during the course of the game as an added inducement for players to continue in the game to see the remaining cards (and of course make additional wagers). The operator can set the amount of the prize according to the number of players, statistically expected value of a winning hand, etc. Alternatively the operator can establish a fixed prize value in advance for a designated hand (say $300 for a given poker hand like 5 Aces), or for so many points and the like. If this is not won on that hand, then a certain amount is carried over to the next draw as is done in progressive lotteries. Alternatively the top prize can be set lower so that a multiple of players can win if they achieve a designated hand or better. The operator can also use a combination of fixed and pari-mutuel payout plans to make the game more attractive in the event traffic is low.

In one embodiment, a Chance Scoring Algorithm is used in the poker game. One method of scoring is to multiply the points from predicting the card number (one of 13) by the points from predicting the correct suit (one of 4). For example, the Number of the Card: points=13 less one point for 'how far away' the predicted number is from the actual number, where numbers are their value and face cards Jack, Queen, King, Ace are rated 11, 12, 13, 14 respectively. Additionally, the Suit of the Card: Points equal 4 if correct, 1 if not. An example is shown in the table below.

| Example: | Predicted | Actual | Score |
|---|---|---|---|
| Number | Q | 5 | 13 − (12 − 5) = 6 |
| Suit | spades | spades | 4 |
| Total | | | 24 (=6 × 4) |

In this example, the maximum score for each card would be 52: (13−0)×4=52. For a 7 card game like Texas Hold'm the maximum points would be 52×5=260. Alternatively, the operator could add the points for predicting the number to the points for predicting the suit to get a total number of points. Although this example is for playing cards, the game could be played with Mah Jong tiles or other tile or card games.

The elements are of a preferred embodiment are: a pari-mutuel poker system with an unlimited number of players playing simultaneously whether over the Internet or linked through conventional or server based slot machines within a single or group of casinos, interactive television, and hand held wireless devices or other means; a chance card game with scoring system similarly played as an aggregated game, the combination of the two games in one game with the pot being shared in some manner; the feature of offering a given player a cash offer during the course of the play of the game where that player must either accept the offer or continue the play; enabling the selected player to increase his wager at a given point in return for increased payout; the broadcast of that offer to other players increasing their excitement; the deduction of that accepted offer from the prize pool so that the operator is not at a financial risk; the addition of a jackpot prize for a high Chance score or high poker hand with either fixed odds or pari-mutuel payout; the use of a carry over system to build a jackpot for future players, who would benefit from the larger jackpots than is the case with the pool from a single hand; awarding points for predicting the rank of poker hand that will win a given hand and creation of a separate pool for that event; varying the size of the fixed wager with each betting round; offering each player an additional wagering opportunity by paying a fee to receive a display of the highest poker or Chance hand at a given point; and enabling play of the game over interactive television where the players at home are included in the pool of players whether. It is envisioned that these features may be utilized together in any combination.

One exemplary game is a combination game with the following guidelines. A modified Poker game played simultaneously by an unlimited number of players. The pot is split between the high poker hand and the high Points hand where players get points for predicting the next card. Alternatively, the ceiling payout can be fixed to accommodate local rules. Each player plays with one deck and the Community Cards displayed are from a separate deck. As a result, the highest possible hand is 6 aces (2 hole cards plus 5 Community Cards). There is no limit to the number of players in one game. A new game starts each hour (the frequency of starts can vary according to interest).

For a Texas Hold'm Play (2 cards down, then 5 community cards in three rounds (3-Flop, 1-Turn, 1-River), the game can also use the following: 1st fee—to ante and get 2 cards (F1); 2nd fee—to see the Flop (F2); 3rd fee—to see the Turn card (F3); 4th fee—to see the River card (F4); Prize awards; High 5 (or 6) card poker hand gets 5,000 points; Points for each poker hand; Royal straight flush (to be determined by operator); Straight flush (to be determined by operator); 4 of a kind (to be determined by operator); Flush (to be determined by operator); Full House (to be determined by operator); Straight (to be determined by operator); 3 of a kind (to be determined by operator); 2 Pair (to be determined by operator); One Pair (to be determined by operator); and On each round you predict the next card (Queen of spades, 7 diamonds, etc.).

The embodiment may be further operative to earn additional points depending on how close your prediction is to the actual. It can: Predict on the flop (3 cards)×points; have the entrance fees deducted from the points assigned to your hand to give your net points for each game; and/or let your points accumulate in your Poker Account and Prizes are awarded each week to the #1 Player.

Pari-Mutuel Poker Alternative Rules

In another embodiment, players play poker in real time against other players. Each player is dealt cards from his own virtual deck of 52 cards. This enables an unlimited number of players to play simultaneously. The screen (VLT, Internet or mobile phone screen) alerts players that a new game will start, for example, in 1 minute and provides a countdown. In the Texas Hold'm version, players must put up an ante to play. The screen displays how many players are in the game. After the clock counts down to zero, each player is dealt 2 cards from their own 52 card virtual deck. Each player can see his own cards, but not anyone else's cards. Each player must then decide to pay and extra bet to see the next 3 cards or fold. Any player that folds cannot win any money. The screen displays how many players are still in the game. Each player that paid the extra money is shown 3 cards. All players see the same 3 cards. Each player either folds or pays extra money to see another card. A fourth card is dealt to all players still in the game. Each player still in the game now has 6 cards, four cards that everyone sees and two that only he can see. Each player either folds or pays an extra yuan to see the last card. A fifth card is dealt to all players still in the game. Each player still in the game now has 7 cards, five cards that everyone sees and two that only he can see. The screen displays how many players are still in the game. Each player either folds or pays an extra yuan to see who wins. The player or players with the highest poker hand from all remaining players is the winner.

It will be appreciated by those of ordinary skill in the pertinent art that the functions of several elements may, in alternative embodiments, be carried out by fewer, or a single element. Similarly, in some embodiments, any functional element may perform fewer, or different, operations than those described with respect to the illustrated embodiment. Also, functional elements (e.g., modules, databases, interfaces, computers, servers and the like) described as distinct for purposes of illustration may be incorporated within other functional elements in a particular implementation. While the invention has been described with respect to preferred embodiments, those skilled in the art will readily appreciate that various changes and/or modifications can be made to the invention without departing from the spirit or scope of the invention as defined by the appended claims.

What is claimed is:

1. A method for pari-mutuel betting, wherein a server communicates with clients via a distributed computing network, the method comprising the steps of:

(a) enrolling gamblers in a server database for at least one pari-mutual wager event by presenting betting rules associated with the at least one pari-mutual wager event on clients associated with the gamblers;

(b) assigning point awards to categories associated with the at least one pari-mutual wager event as part of the betting rules;

(c) collecting wagers from the gamblers and updating the server database based on the wagers;

(d) forming a pool from the wagers, the pool being less than a total of the wagers and storing data representing the pool in the server database;

(e) accepting predictions from each gambler for discrete events within the categories for the at least one pari-mutual wager event, wherein the predictions are received from the clients by the server, which updates the server database based on the predictions;

(f) allocating points to the gamblers based upon the correct and incorrect predictions and updating the server database based on the points, wherein correct predictions are worth more points than incorrect predictions;

(g) in the server, determining rankings of the gamblers based upon the points allocated thereto; and (h) distributing at least a portion of the pool according to the rankings, wherein the at least one event is a lottery where a subset of numbers are chosen sequentially from a preselected range by a method selected from the group consisting of reading manually completed sheets, receiving Internet submissions, receiving text message wagers and predictions, receiving wagers and predictions from mobile telephones and combinations thereof, wherein the lottery is multi-jurisdictional and progressive with a large initial payout, and at least one winner is determined by a lowest score based upon an accumulated sum for each drawn number of an absolute value of a difference between a predicted number and the drawn number.

2. A method as recited in claim 1, further comprising the step of varying the points for a category in a predetermined manner in inverse proportion to a time elapsed in the lottery.

3. A method as recited in claim 1, wherein the lottery has multiple games that are selected for prediction of winners and final scores by a method selected from the group consisting of reading manually completed sheets, receiving Internet submission, receiving text message wagers and predictions, receiving wagers and predictions from mobile telephones and combinations thereof.

4. A method as recited in claim 1, wherein the wagers and predictions are received before and during the lottery.

5. A method as recited in claim 1, further comprising the step of providing a number of players and a size of the pool for review by the gamblers on the clients.

6. A method for pari-mutuel betting, wherein a server communicates with clients via a distributed computing network, the method comprising the steps of:

(a) enrolling gamblers in a server database for at least one pari-mutual wager event by presenting betting rules associated with the at least one pari-mutual wager event on clients associated with the gamblers;

(b) assigning point awards to categories associated with the at least one pari-mutual wager event as part of the betting rules;

(c) collecting wagers from the gamblers and updating the server database based on the wagers;

(d) forming a pool from the wagers, the pool being less than a total of the wagers and storing data representing the pool in the server database;

(e) accepting predictions from each gambler for discrete events within the categories for the at least one pari-mutual wager event, wherein the predictions are received from the clients by the server, which updates the server database based on the predictions;

(f) allocating points to the gamblers based upon the correct and incorrect predictions and updating the server database based on the points, wherein correct predictions are worth more points than incorrect predictions;

(g) in the server, determining rankings of the gamblers based upon the points allocated thereto; and (h) distributing at least a portion of the pool according to the rankings, wherein:

the at least one event is a poker card game;

wagers are collected after commencement of the at least one event;

rules of the poker card game are stored in the server database;

each gambler receives a hand from a virtual deck associated with the respective gambler; and each player improves upon the hand with at least one community card from a virtual community deck, and further comprising the steps of splitting the pool between the gambler with a highest poker hand and the gambler a highest point allocation.

7. A method as recited in claim 6, further comprising the steps of:

varying the points for a category in a predetermined manner in inverse proportion to a time elapsed in the poker card game, providing a number of players and a size of the pool for review by the gamblers on the clients, and wherein the wagers and predictions are received before and during the poker card game.

8. A method as recited in claim 6, wherein:

wagers are collected after commencement of the poker card game;

rules of the poker card game are stored in the server database; and each gambler receives a virtual deck and makes predictions that are an outcome of a next card that is electronically turned over until all cards in the virtual deck have been turned over.

9. A method as recited in claim 8, wherein when the virtual deck has four suits and thirteen cards persuit, four points are awarded for selecting a correct suit of the next card, and points are awarded based on selecting a card value according to a formula as follows:

points=13−absolute value of(predicted value−actual value).

10. A method as recited in claim 6, wherein the poker card game has multiple games that are selected for prediction of winners and final scores by a method selected from the group consisting of reading manually completed sheets, receiving Internet submission, receiving text message wagers and predictions, receiving wagers and predictions from mobile telephones and combinations thereof.

11. A method for pari-mutuel betting, wherein a server communicates with clients via a distributed computing network, the method comprising the steps of:

(a) enrolling gamblers in a server database for at least one pari-mutual wager event by presenting betting rules associated with the at least one pari-mutual wager event on clients associated with the gamblers;

(b) assigning point awards to categories associated with the at least one pari-mutual wager event as part of the betting rules;

(c) collecting wagers from the gamblers and updating the server database based on the wagers;

(d) forming a pool from the wagers, the pool being less than a total of the wagers and storing data representing the pool in the server database;

(e) accepting predictions from each gambler for discrete events within the categories for the at least one pari-mutual wager event, wherein the predictions are received from the clients by the server, which updates the server database based on the predictions;

(f) allocating points to the gamblers based upon the correct and incorrect predictions and updating the server database based on the points, wherein correct predictions are worth more points than incorrect predictions;

(g) in the server, determining rankings of the gamblers based upon the points allocated thereto; and (h) distributing at least a portion of the pool according to the rankings, wherein: the at least one event is a poker card game; wagers are collected after commencement of the at least one event; rules of the poker card game are stored in the server database; each gambler receives a hand from a virtual deck associated with the respective gambler; and each player improves upon the hand with at least one community card from a virtual community deck, and further comprising the step of creating a secondary pool based upon wagers on an outcome of a next card that is electronically dealt from a virtual deck associated with the gambler and a next card turned over from the virtual community deck.

12. A method as recited in claim 11, further comprising the steps of:

varying the points for a category in a predetermined manner in inverse proportion to a time elapsed in the poker card game; and providing a number of players and a size of the pool for review by the gamblers on the clients, and wherein the wagers and predictions are received before and during the poker card games.

13. A method as recited in claim 11, wherein:

wagers are collected after commencement of the poker card game;

rules of the poker card game are stored in the server database; and each gambler receives a virtual deck and makes predictions that are an outcome of a next card that is electronically turned over until all cards in the virtual deck have been turned over.

14. A method as recited in claim 13, wherein when the virtual deck has four suits and thirteen cards persuit, four points are awarded for selecting a correct suit of the next card, and points are awarded based on selecting a card value according to a formula as follows:

points=13−absolute value of(predicted value−actual value).

15. A method as recited in claim 11, wherein the poker card game has multiple games that are selected for prediction of winners and final scores by a method selected from the group consisting of reading manually completed sheets, receiving Internet submission, receiving text message wagers and predictions, receiving wagers and predictions from mobile telephones and combinations thereof.

16. A method for pari-mutuel betting, wherein a server communicates with clients via a distributed computing network, the method comprising the steps of:

(a) enrolling gamblers in a server database for at least one pari-mutual wager event by presenting betting rules associated with the at least one pari-mutual wager event on clients associated with the gamblers;

(b) assigning point awards to categories associated with the at least one pari-mutual wager event as part of the betting rules;

(c) collecting wagers from the gamblers and updating the server database based on the wagers;

(d) forming a pool from the wagers, the pool being less than a total of the wagers and storing data representing the pool in the server database;

(e) accepting predictions from each gambler for discrete events within the categories for the at least one pari-mutual wager event, wherein the predictions are received from the clients by the server, which updates the server database based on the predictions;

(f) allocating points to the gamblers based upon the correct and incorrect predictions and updating the server database based on the points, wherein correct predictions are worth more points than incorrect predictions;

(g) in the server, determining rankings of the gamblers based upon the points allocated thereto; and (h) distributing at least a portion of the pool according to the rankings, wherein:

the at least one event is a card game;

wagers are collected after commencement of the at least one event;

rules of the card game are stored in the server database; and each gambler receives a virtual deck and the predictions are an outcome of a next card that is electronically turned over until all cards in the virtual deck have been turned over and when the virtual deck has four suits and thirteen cards persuit, four points are awarded for selecting a correct suit of the next card, and points are awarded based on selecting a card value according to a formula as follows:

points=13−absolute value of(predicted value−actual value).

17. A method as recited in claim 16, further comprising the steps of:

varying the points for a category in a predetermined manner in inverse proportion to a time elapsed in the at least one event; and providing a number of players and a size of the pool for review by the gamblers on the clients, and wherein the wagers and predictions are received before and during the card game.

18. A method as recited in claim 16, wherein the card game has multiple games that are selected for prediction of winners and final scores by a method selected from the group consisting of reading manually completed sheets, receiving Internet submission, receiving text message wagers and predictions, receiving wagers and predictions from mobile telephones and combinations thereof.

* * * * *